United States Patent [19]

Dodson

[11] Patent Number: 4,952,140

[45] Date of Patent: Aug. 28, 1990

[54] TREATING FLUID MATTER

[75] Inventor: Christopher E. Dodson, Reading, England

[73] Assignee: Mortimer Technology Holdings Limited, England

[21] Appl. No.: 172,247

[22] Filed: Mar. 23, 1988

[30] Foreign Application Priority Data

Mar. 23, 1987 [GB] United Kingdom ..... 8706852

[51] Int. Cl.[5] ..... F26B 3/10

[52] U.S. Cl. ..... 34/10; 34/57 R; 432/15; 432/58

[58] Field of Search ..... 432/15, 58; 34/57 R, 34/57 A, 10

[56] References Cited

U.S. PATENT DOCUMENTS 4,433,631 2/1984 Lindahl ..... 432/58

FOREIGN PATENT DOCUMENTS 68853 3/1987 European Pat. Off. .

1500231 2/1978 United Kingdom .

*Primary Examiner*—Henry A. Bennet

*Attorney, Agent, or Firm*—Watson, Cole, Grindle & Watson

[57] ABSTRACT

A bed 26 of particulate material is moved in a band continuously along an annular path by passing fluid media having both circumferential and vertical components through the bed along that path. The fluid media comprises combustion gases which are passed through the bed along a portion of the path for heating the particulate material as it passes therethrough and fluid matter to be heated which passes through the bed along another portion of its path such that the fluid matter is heated as it passes through the particulate material which has been heated by the combustion gases.

20 Claims, 1 Drawing Sheet

TREATING FLUID MATTER

BACKGROUND OF THE INVENTION

This invention relates to treating fluid matter and particularly, but not exclusively, to heating gaseous matter.

EP-B-68853 discloses moving a bed of particulate material in a band continuously along an annular path by passing a fluid medium provided as combustion gases having both circumferential and vertical components through the bed along its path. The combustion gases heat the particulate material as they pass through the bed, and matter, which may be other particulate material, is added to the bed so as to mix with the heated particulate matter and be heated thereby.

An object of the present invention is to utilise a bed of particulate material which moves in a band along an annular path as aforesaid for treating fluid matter.

SUMMARY OF THE INVENTION

The invention includes a method of treating fluid matter, comprising moving a bed of particulate material in a band continously along an annular path by passing fluid media having both circumferential and vertical components through the bed along the path, the fluid media comprising fluid which is passed through the bed along a portion of the path along which the particulate material is treated and, fluid matter to be treated which passes through the bed along another portion of the path, such that the fluid matter is treated as it passes through the particulate material which has been treated during its passage through the first mentioned portion.

The fluid media may comprise fluid and fluid matter to be treated which pass through the bed along alternately disposed portions of the annular path, the particulate material being treated in the portions in which fluid is passed through the bed.

The fluid media may comprise other fluid which is passed through the bed along other portions of the annular path.

The particulate material may be treated by the fluid as the fluid passes through the bed. Alternatively the fluid may simply serve to move the bed along the or each portion of the path through which it is passed, the particulate material being otherwise treated during its passage along that or those portions of the path.

The fluid may comprise combustion gases which are used to heat the particulate material as they pass through the bed such that the fluid matter is heated as it passes through the particulate material which has been heated by the combustion gases.

Thus, the invention includes a method of heating fluid matter, comprising moving a bed of particulate material in a band continuously along an annular path by passing fluid media having both circumferential and vertical components through the bed along the path, the fluid media comprising combustion gases which are passed through the bed along a portion of the path for heating the particulate material as it passes therethrough and fluid matter to be heated which passes through the bed along another portion of the path such that the fluid matter is heated as it passes through the particulate material which has been heated by the combustion gases.

The fluid media may comprise combustion gases and fluid matter to be heated which pass through the bed along alternately disposed portions of the annular path.

The fluid media may comprise other fluid which is passed through the bed along other portions of the annular path. For example the fluid, media may comprise a purging gas which is passed through the bed along a portion of the path thereof between a portion along which the combustion gases are passed and a portion along which the fluid matter to be heated is passed.

It will be appreciated that in the method as aforesaid the combustion gases do not pass through the bed along all of its annular path. However, it is to be understood that the method may comprise initially passing combustion gases through the bed along all, or substantially all, of the annular path in order to bring the bed up to a desired temperature as quickly as possible.

Preferably, the flow of fluid matter which has been heated by passing through the bed is maintained separate from the rest of the fluid media after it has passed through the bed.

As mentioned previously, the method is particularly applicable to heating gaseous matter and, for example, may advantageously be used for the pyrolysis of gas.

The invention also provides apparatus for treating fluid matter comprising a chamber for a bed of particulate material, the base of which chamber is provided with an annular fluid media inlet means, means for imparting vertical and circumferential components to the flow of fluid media through the inlet means for moving a bed of particulate material in the chamber in use in a band along an annular path in the chamber as the fluid media passes through the particulate material, first passage means for supplying fluid to the annular fluid media inlet means along a first portion thereof, second passage means for supplying fluid matter to be treated to the annular fluid media inlet means along a second portion thereof, and outlet means for the fluid media after it has passed through the bed comprising separate outlet means for the fluid and the fluid matter.

The apparatus may comprise a plurality of first passage means for supplying the fluid to the annular fluid media inlet means along respective first portions thereof, a plurality of second passage means for supplying fluid matter to be treated to the annular fluid media inlet means along respective second portions thereof, which second portions are arranged alternately with the first portions, the outlet means comprising separate outlet means for the fluid and fluid matter from each the passage means. The or each first passage means may be arranged to supply combustion gases to the inlet means along the or each first portion thereof.

The apparatus may also include respective third passage means for supplying purging gas to the annular fluid media inlet means along a respective third portion thereof between the or each first portion and the or each second portion downstream thereof.

The or each first passage means may have fuel supply means located therein and disposed beneath the or each first portion of the fluid media inlet means along the extent thereof. Additionally, separately controllable fuel supply means may be located beneath the remainder of the fluid annular media inlet means along the extent thereof.

In one particular embodiment of the invention, described hereinafter, the chamber is bounded externally by an axially intermediate portion of a tubular wall, the passage means being defined at least partially by lower partitioning extending inwardly of the tubular wall beneath the annular fluid media inlet means and the separate outlet means being defined at least partially by upper partitioning extending inwardly of the tubular wall above and spaced from the annular fluid media inlet means.

The upper partitioning may be located angularly offset with respect to the lower partitioning in the sense in which the bed is moved along the annular path in use.

The means for imparting vertical and circumferential components to the flow of fluid media through the inlet means may comprise an annular array of fixed inclined vanes. These vanes may be arranged in overlapping relationship.

In order that the invention may be well understood, an embodiment thereof, which is given by way of example only, will now be described with reference to the accompanying drawings.

DETAILED DESCRIPTION OF THE PREFERRED EMBODIMENT

Figure 1:
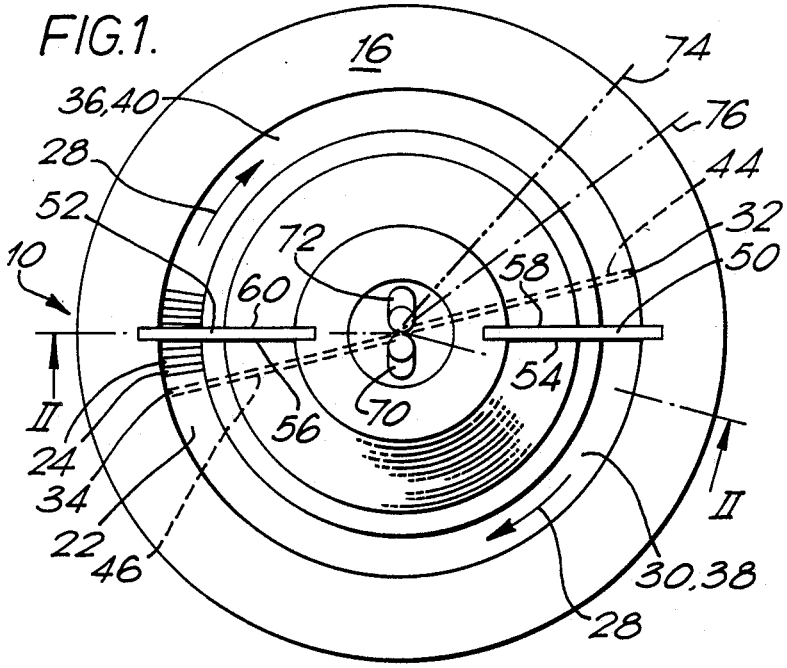
FIG. 1 is a schematic top plan view of a preferred apparatus for treating fluid matter according to the present invention.
Figure 2:
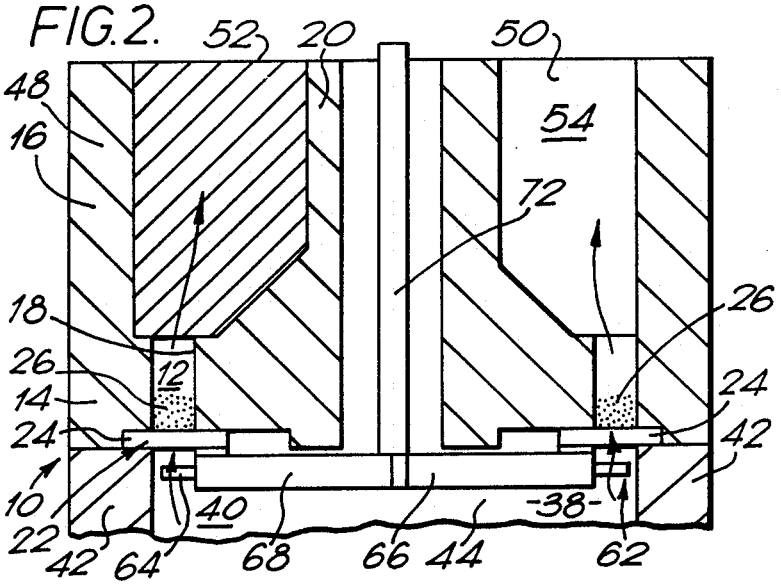
FIG. 2 is an axial cross-section view of the same apparatus taken along the line II—II of FIG. 1.

The apparatus 10 shown in the drawing's includes a chamber 12 which is bounded externally by an axially intermediate portion 14 of a tubular wall 16 of the apparatus. In the illustrated apparatus, the chamber 12 is annular, being bounded internally by an annular wall 18 of a central structure 20 of the apparatus. The base of the chamber is provided with an annular fluid media inlet 22 which is spanned by an annular array of fixed inclined vanes 24. For simplicity, only a portion of the array of vanes is illustrated in FIG. 1. However, it is to be understood that the array extends completely around the inlet 22. The vanes 24, which in the embodiment are arranged in overlapping relationship, are inclined in order to impart vertical and circumferential components to a flow of fluid media through the annular inlet 22 to move a bed of particulate material disposed in the chamber 12 in use of the apparatus and indicated at 26 in FIG. 2 in a compact band continuously along an annular path in the chamber 12 as the fluid media passes through the particulate material. In the embodiment, the vanes are arranged so that the bed of particulate material moves along this annular path in the sense indicated by arrows 28 in FIG. 1.

The illustrated apparatus is utilised for treating fluid matter by heat and the fluid media which passes through the particulate material comprise combustion gases which are supplied to the annular inlet 22 along a first portion 30 thereof extending over 180° between locations 32 and 34 indicated in FIG. 1 and fluid matter to be heated in the apparatus which is supplied along a second portion 36 of the annular inlet 22 extending through 180° between locations 34 and 32.

It will be appreciated that the combustion gases heat the particulate material as they pass through the bed along a first portion of its annular path and the fluid matter is heated as it passes through the particulate material, which has been previously heated by the combustion gases, along a second portion of the bed's annular path.

The apparatus includes respective passages 38,40 for supplying the combustion gases and fluid matter to the inlet portions 30 and 36. These passages are bounded by an annular portion 42 of the tubular wall 16 beneath the inlet 22 and by partitioning 44,46 extending inwardly of the tubular wall portion 42 to divide the space within the tubular wall beneath the inlet 22 into passage 38 extending beneath portion 30 of the inlet 22 and passage 40 extending beneath portion 36 thereof.

The apparatus also includes respective outlet passages for the combustion gases and fluid matter after their passage through the bed of particulate material 26. These passages are bounded by an annular portion 48 of the tubular wall 16 above the portion 14 thereof which bounds the chamber 12 and by partitioning 50, 52 extending inwardly of the tubular wall from the portion 16 thereof to the central structure 20 of the apparatus. The partitioning 50, 52 is spaced above the annular inlet 22 so as not to interfere with the progress of the bed along its annular path in the chamber 12. The outlet passage for combustion gases which have passed through portion 30 of the inlet 22 is defined between surfaces 54, 56 of the partitioning 50, 52 and the outlet passage for fluid matter which has passed through the portion 36 of the inlet 22 is defined between surfaces 58 and 60 of the partitioning 50, 52.

It will be noted that the upper partitioning 50, 52 for the outlet passages is located angularly offset with respect to the lower partitioning 44, 46 in the sense in which the bed is moved along the annular path. This is to ensure that combustion gases passing through portion 30 of the inlet 22 adjacent partitioning 34 pass through the outlet passage for the combustion gases after it has travelled through the chamber 12 with a circumferential component in the sense indicated by arrows 28.

The passage 38 extending beneath portion 30 of the inlet 22 has fuel supply means, which are generally indicated at 62 in FIG. 1, located therein and disposed beneath the portion 30 of the inlet 22 along the extent of portion 30 for supplying fuel for combustion with air passing through passage 38 to provide combustion gases to portion 30. Separately controllable fuel supply means, which are generally indicated at 64 in FIG. 1, are located beneath the remainder of the inlet 22 along the extent thereof. That is, in the illustrated embodiment, they are located in passage 40 beneath portion 36 of the inlet 22 along the extent of portion 36. The supply means 64 are arranged for supplying fuel for combustion with air passing through passage 40 during start-up of the apparatus to provide combustion gases to portion 36 of the inlet. In this way, during start-up combustion gases can be passed through the bed 26 along all of its annular path to ensure that the bed can be brought up to a desired operating temperature as quickly as possible. It is to be understood that after the bed has been brought up to its desired temperature, the supply of fuel through fuel supply means 64 would be terminated and the fluid matter to be heated in the apparatus would be passed through passage 40 to portion 36 of the inlet 22 instead of air for combustion. The fuel supply means 62 and 64 may take any conventional form and are illustrated in the embodiment as fuel injectors disposed beneath the respective portions 30, 36 of the inlet 22 which are fed by manifolds 66 and 68 respectively. These manifolds are connected to a supply of fuel by respective pipes 70, 72 extending through the central structure 20 of the apparatus. As will be appreciated each pipe 70, 72 is provided with a respective flow control valve (not illustrated) so that the flow through the pipes can be separately controlled.

It is to be understood that whilst in the illustrated embodiment the portion 30 of the inlet 22 through which the combustion gases are passed and the portion 36 thereof through which the fluid matter to be heated is passed are each 180°, their angular extent may be varied. Further the embodiment may be modified so that combustion gases and fluid matter to be heated pass through the bed along alternately disposed portions of its annular path. For this purpose, the apparatus may be modified to include a plurality of first passages for supplying combustion gases to the inlet 22 along respective first portions of the inlet and a plurality of second passages for supplying fluid matter to be heated to the inlet 22 along respective second portions thereof, the second portions being arranged alternately with the first portions. This may be achieved by providing additional partitioning beneath the inlet 22 similar to partitioning 40, 46 but angularly spaced therefrom. In this case separate outlets for the combustion gases and fluid matter from each of the passages beneath the inlet 22 are provided, for example, by providing additional partitioning above the inlet 22 similar to partitioning 50, 52 but angularly spaced therefrom. In such a modified apparatus fuel supply means would be provided in the first passages and separately controllable fuel supply means may be provided in the second passages for startup.

It is also envisaged that the embodiment may be modified such that another fluid, for example a purging gas, can be passed through the bed along a portion of its path between that portion thereof along which the combustion gases are passed and that portion along which the fluid matter to be heated is passed. For example, the illustrated embodiment may be modified to incorporate additional partitioning 74, 76 indicated by chain-dotted lines in FIG. 1 upstream of the partitioning 44 and 50, respectively, to define with the partitioning 44 and 50 a passage beneath the inlet 22 for supplying purging gas to the inlet along the portion thereof between partitioning 74 and 44 and a passage between partitioning 76 and 50 above the inlet for the outlet of the purging gas.

Whilst the embodiment has been described in relation to heating fluid matter, it is to be understood that the invention is also applicable to treating fluid matter in other ways, in which case fluid other than combustion gases could be supplied to the portion or portions of the inlet 22 to which combustion gases are supplied in the embodiment with the particulate material being treated either by that other fluid or by other means as it is moved by that other fluid along a portion or portions of its annular path, the fluid matter passing through the thus treated particulate matter along another portion or other portions of the path being treated thereby. One particular other application is the cleaning of gaseous matter by contact with material coated on the particulate material.

I claim:

1. A method of treating fluid matter, comprising moving a bed of particulate material in a band continuously along an annular path by passing fluid media having both circumferential and vertical components through said bed along said path, said fluid media comprising fluid and fluid matter to be treated which pass through said bed along alternately disposed first and second portions of said annular path, such that the particulate material is treated as it passes through said first portions in which fluid is passed through the bed and the fluid matter is treated in said second portions as it passes through the particulate material which has been treated during its passage through said first portions.

2. A method as claimed in claim 1, wherein said fluid media comprises other fluid which is passes through said bed along other portions of said annular path.

3. A method as claimed in claim 1, wherein said particulate material is treated by said fluid as said fluid passes through the bed.

4. A method as claimed in claim 1, including maintaining said flow of fluid matter separate from the rest of said fluid media after it has passed through said bed.

5. A method as claimed in claim 1, wherein said fluid matter to be heated comprises gaseous matter.

6. A method of heating fluid matter, comprising moving a bed of particulate material in a band continuously along an annular path by passing fluid media having both circumferential and vertical components through said bed along said path, said fluid media comprising combustion gases and fluid matter to be heated which pass through said bed along alternately disposed first and second portions of said annular path, such that the combustion gases heat the particulate material as is passes through said first portions and the fluid matter is heated in said second portions as it passes through the particulate material which has been heated by said combustion gases.

7. A method as claimed in claim 6, wherein said fluid media comprises other fluid which is passed through said bed along other portions of said annular path.

8. A method as claimed in claim 6, wherein said fluid media comprises a purging gas which is passed through said bed along a portion of the path thereof between a portion along which said combustion gases are passed and a portion along which said fluid matter to be heated is passed.

9. A method as claimed in claim 6, comprising initially passing combustion gases through said bed along all, or substantially all, of said annular path.

10. A method of heating fluid matter, comprising moving a bed of particulate material in a band continuously along an annular path by passing fluid media having both circumferential and vertical components through said bed along said path, said fluid media comprising (i) combustion gases which are passed through said bed along a portion of said path for heating the particulate material as it passes therethrough, (ii) fluid matter to be heated which passes through said bed along another portion of said path such that the fluid matter is heated as it passes through the particulate material which has been heated by said combustion gases, and (iii) a purging gas which is passed through said bed along a portion of the path thereof between a portion along which said combustion gases are passed and a portion along which said fluid matter to be heated is passed.

11. Apparatus for treating fluid matter, comprising a chamber for a bed of particulate material, the base of inlet means, means for imparting vertical and circumferential components to the flow of fluid media through said inlet means for moving a bed of particulate material in said chamber in use in a band along an annular path in said chamber as said fluid media passes through said particulate material, first passage means for supplying fluid to said annular fluid media inlet means along a first portion thereof, second passage means for supplying fluid matter to be treated to said annular fluid media inlet means along a second portion thereof, and outlet means for said fluid media after it has passed through said bed comprising separate outlet means for said fluid and said fluid matter.

12. Apparatus as claimed in claim 11, comprising a plurality of first passage means for supplying said fluid to said annular fluid media inlet means along respective first portions thereof, a plurality of second passage means for supplying fluid matter to be treated to said annular fluid media inlet means along respective second portions thereof which second portions are arranged alternately with said first portions, said outlet means comprising separate outlet means for said fluid and fluid matter from each said passage means.

13. Apparatus as claimed in claim 11, wherein the or each first passage means is arranged to supply combustion gases to said inlet means along the or each first portion thereof.

14. Apparatus as claimed in claim 13, including respective third passage means for supplying purging gas to said annular fluid media inlet means along a respective third portion thereof between the or each first portion and the or each second portion downstream thereof.

15. Apparatus as claimed in claim 13, wherein the or each first passage means has fuel supply means located therein and disposed beneath the or each first portion of the fluid media inlet means along the extent thereof.

16. Apparatus as claimed in claim 15, wherein said fluid media inlet means is divided into at least one first portion and a remainder portion and wherein separately controllable fuel supply means are located beneath the remainder portion of said annular fluid media inlet means along the extent thereof.

17. Apparatus as claimed in claim 11, wherein said chamber is bounded externally by a portion of a tubular wall, said passage means being defined at least partially by lower partitioning extending inwardly of said tubular wall beneath said annular fluid media inlet means and said separate outlet means being defined at least partially by upper partitioning extending inwardly of said tubular wall above and spaced from said annular fluid media inlet means.

18. Apparatus as claimed in claim 17, wherein the upper partitioning is located angularly offset with respect to said lower partitioning in the sense in which the bed is moved along the annular path in use.

19. Apparatus as claimed in claim 11, wherein said means for imparting vertical and circumferential components to the flow of fluid media through said inlet means comprises an annular array of fixed inclined vanes.

20. Apparatus as claimed in claim 19, wherein said vanes are arranged in overlapping relationship.

* * * * *